US005501336A

United States Patent [19]

De Maria

[11] Patent Number: 5,501,336

[45] Date of Patent: Mar. 26, 1996

[54] GENERIC GOODS-CONTAINING CRATE

[75] Inventor: Giuseppe De Maria, Caronno Varesino, Italy

[73] Assignee: Proge Plast Engineering S.r.l., Gallarate, Italy

[21] Appl. No.: 341,983

[22] Filed: Nov. 16, 1994

[30] Foreign Application Priority Data

Nov. 29, 1993 [IT] Italy ..... MI93A2511

[51] Int. Cl.[6] ..... B65D 21/06

[52] U.S. Cl. ..... 206/505; 206/506

[58] Field of Search ..... 206/505, 506, 206/518

[56] References Cited

U.S. PATENT DOCUMENTS

| | | | |
|---|---|---|---|
| 3,651,977 | 3/1972 | Morgan . | |
| 4,109,791 | 8/1978 | Cupson et al. | 206/505 |
| 4,247,004 | 1/1981 | Bird | 206/505 |
| 5,131,708 | 7/1992 | Denzin | 206/505 |
| 5,360,114 | 11/1994 | Weidt | 206/505 |

FOREIGN PATENT DOCUMENTS

| | | |
|---|---|---|
| 0052893 | 6/1982 | European Pat. Off. . |
| 0507030 | 10/1992 | European Pat. Off. . |
| 2519322 | 7/1983 | France . |
| 2613958 | 10/1976 | Germany . |
| 9112713 | 9/1991 | WIPO . |

*Primary Examiner*—Joseph M. Moy
*Attorney, Agent, or Firm*—Guido Modiano; Albert Josif

[57] ABSTRACT

Generic goods-containing crate that can be stacked during use and can be partially interlocked to form a pack during storage, which has the particularity that it comprises a central tray-like body which has a bottom that is delimited, along its perimeter, by inner side walls which are tilted outwards from the bottom towards the upper edge. At least portions of outer side walls extend from the upper edge, surround the inner side walls, and are inclined outwards from the upper edge towards the free edge. Stacking and reinforcement blocks are furthermore provided which can be arranged in an active position, in which they join the lower ends of the inner side walls and of the at least portions of outer side walls, and in a packing position, in which they arrange themselves below the bottom. The crate is configured so that it has the same overall dimensions both during use and when the crates are packed together.

14 Claims, 5 Drawing Sheets

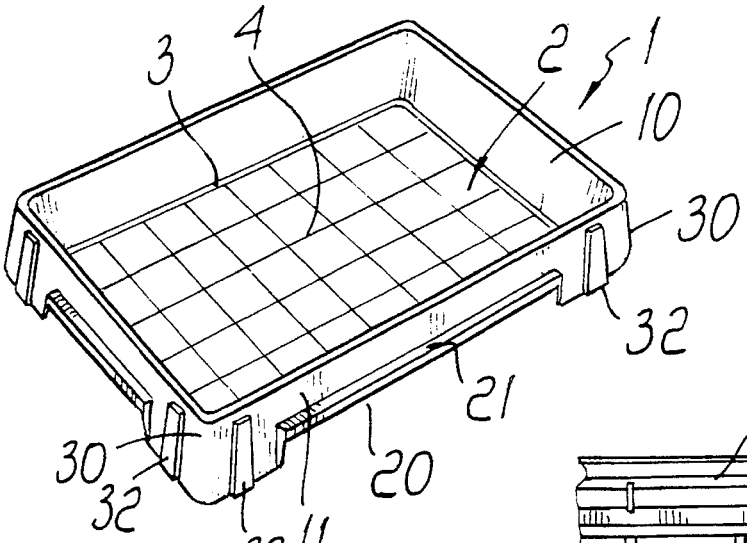
Fig. 1
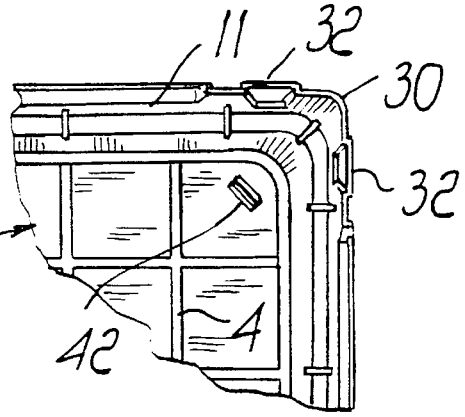
Fig. 4
Fig. 2
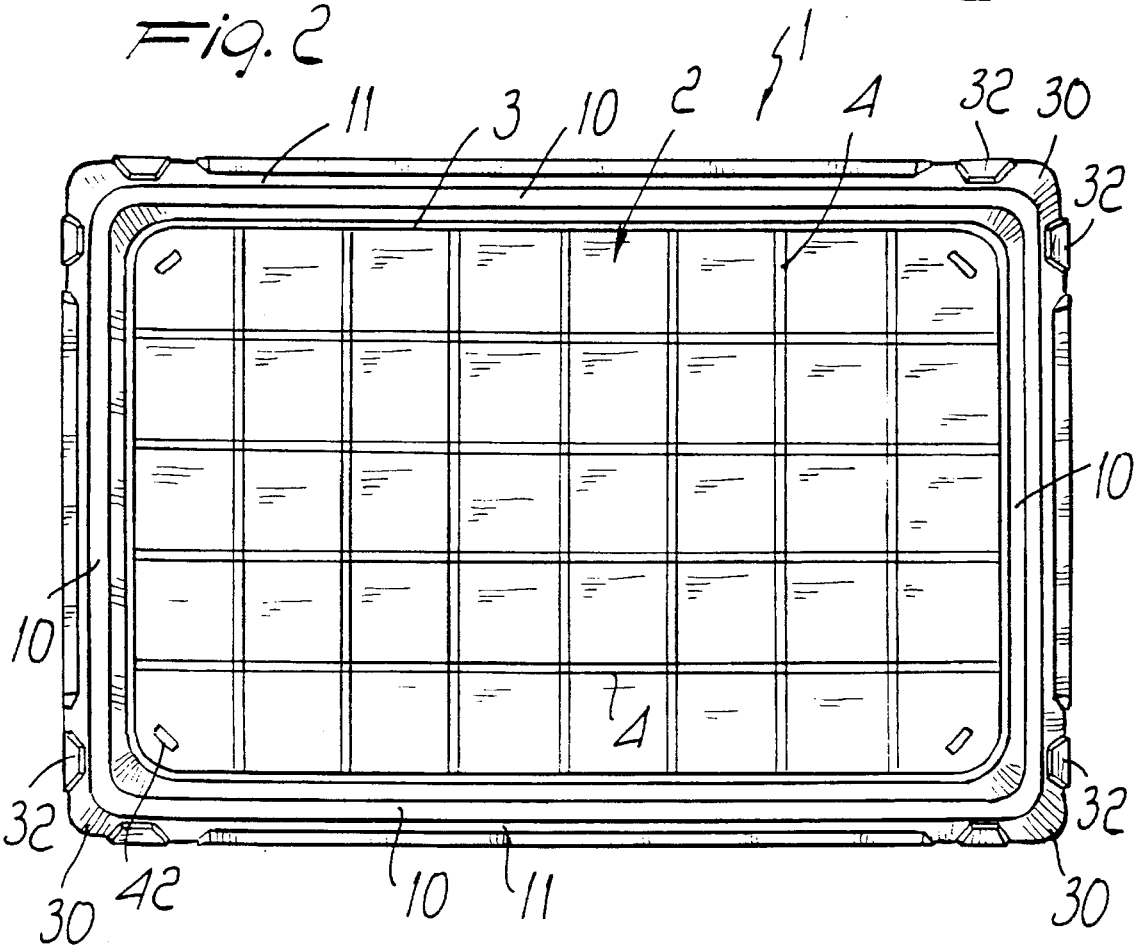

GENERIC GOODS-CONTAINING CRATE

BACKGROUND OF THE INVENTION

The present invention relates to a generic goods-containing crate which can be stacked during use and can be partially mutually interlocked to form packs during storage.

As is known, crates for containing and carrying goods, such as for example for the transport of fruit, vegetables, meat, fish, food products in general, and so forth, are currently used in many fields.

These crates must have sufficient mechanical rigidity so that they can be stacked, and must also be suitable to be fitted inside each other to reduce space occupation both during storage and when the crates return empty.

Currently commercially available solutions are constituted by wood crates, which cannot be mutually packed, or by cardboard crates, which have the advantage that they are assembled when they are to be used and accordingly do not occupy a lot of space during transport when empty.

However, cardboard crates have the drawback that they are not always capable of bearing the weights that occur especially when multiple crates are stacked.

In order to solve the problem, Italian patent application no. MI93A 000180 proposed a crate obtained by means of a thermoformed sheet-like element made of synthetic material which has a central tray-like body provided, at two opposite edges, with L-shaped tabs that can be tilted down with respect to the central body so as to be arranged to the side of the lateral face and to engage beneath the bottom, when the crates are mutually stacked, or so that they are turned over towards the outside of the central body, so as to pack together several empty crates.

This solution is very effective both from a practical and from a mechanical point of view, but it has the drawback that it produces non-standard space occupations for packed crates, since the wings that protrude with respect to the central body lead to dimensions that are not compatible with the dimensions of the pallets that are normally used.

SUMMARY OF THE INVENTION

A principal aim of the present invention is indeed to solve the above described problem by providing a generic goods-containment crate that allows to mutually pack the empty crates both for storage and for transport, without however altering the overall external dimensions of said crates, with respect to the dimensions that said crates have when they are used and are mutually stacked.

Within the scope of this aim, a particular object of the invention is to provide a generic goods-containing crate that can absorb side impacts and furthermore has excellent torsional strength.

Another object of the present invention is to provide a crate that can be made of plastic material, thus allowing to transport goods that release liquids, without compromising the mechanical strength of said crate and furthermore complying with the strictest hygiene characteristics.

Another object of the present invention is to provide a crate that is made of a single material so that it can comply with the strictest plastics recycling standards and also allows to reuse the material.

Another object of the present invention is to provide a crate that can be washed before reuse and furthermore offers the greatest assurances of reliability and safety in use.

This aim, these objects, and others which will become apparent hereinafter are achieved by a generic goods-containing crate that can be stacked during use and can be partially interlocked to form a pack during storage, according to the invention, characterized in that it comprises a central tray-like body having a bottom that is delimited, along its perimeter, by inner side walls which are tilted outwards from the bottom towards the upper edge, at least portions of outer side walls extending from said upper edge, said outer side walls surrounding said inner side walls and being inclined outwards from said upper edge towards the free edge, stacking and reinforcement blocks being furthermore provided which can be arranged in an active position, in which they join the lower ends of said inner side walls and of said at least portions of outer side walls, and in a packing position, in which they arrange themselves below said bottom.

BRIEF DESCRIPTION OF THE DRAWINGS

Further characteristics and advantages will become apparent from the following detailed description of a preferred but not exclusive embodiment of a generic goods-containment crate, illustrated only by way of non-limitative example in the accompanying drawings, wherein:

FIG. 1 is a schematic perspective view of the crate according to the invention;

FIG. 2 is a top plan view of the crate;

FIG. 4 is a detail bottom view of the corner of the crate;

DESCRIPTION OF THE PREFERRED EMBODIMENTS

Figure 3:
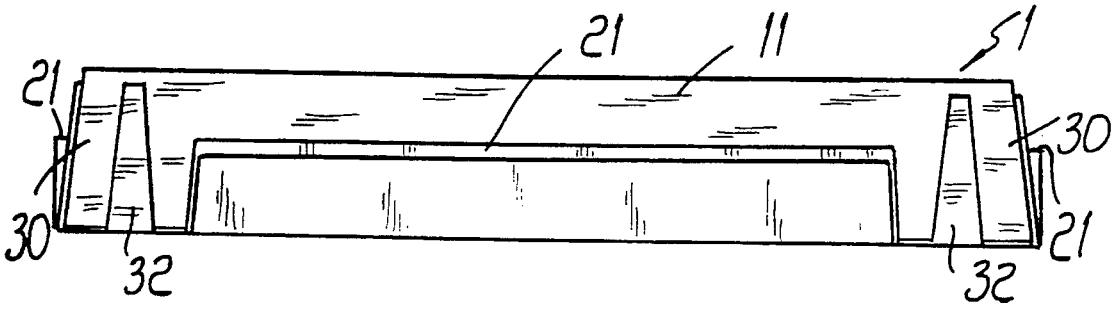
FIG. 3 is an elevation view of the crate.

With reference to the above figures, the generic goods-containing crate that can be stacked during use and can be partially interlocked to form a pack during storage comprises a central tray-like body, generally designated by the reference numeral 1, which is advantageously formed by molding thin panels made of plastic material, such as for example polypropylene; the body 1 may furthermore be produced by thermoforming.

The body 1 has a bottom 2 which advantageously but not necessarily has a rectangular shape with rounded corners and is peripherally provided with a depressed hollow 3 that protrudes towards the lower face; there is also a reinforcement grid constituted by median hollows 4 that mutually intersect so as to form a pattern of squares on the bottom.

The bottom is delimited, at its perimeter, by internal side walls 10 that extend preferably starting from the perimetric hollow 3 and are arranged at an angle with an outward tilt starting from the bottom towards the upper edge.

Outer side walls 11 extend from the upper edge, surround the inner side walls, and are tilted outwards starting from the upper edge towards the lower free edge.

Advantageously but not necessarily, the inner side walls and the outer side walls in practice form a conical shape with a tilt of approximately 5° with respect to the vertical axis.

The outer side walls have, in their median portions, recesses 20 which are delimited, in an upward region and at the vertical edges, by L-shaped wings 21 whose dimensions are such that they do not protrude beyond the footprint of the crate.

The recesses 20 have a dual purpose: the first one is to form lateral grip elements for the crates, and the other one is to lighten the crate, reducing the amount of material required for its use.

The presence of the L-shaped wings 21, in addition to delimiting the recesses at their perimeter, also has the purpose of forming a stiffening element for the crate.

At the corner regions, the outer side walls surround the inner side walls and have recessed portions, designated by the reference numeral 30, which are delimited by trapezoidal protruding regions 32 that form a stiffening ridge for the crate without however limiting their packability, as clarified hereinafter; the protruding regions 32 end proximate to the free edge, leaving free a region in order to avoid hindering the application of an optional lid, as explained hereinafter.

Figure 5:
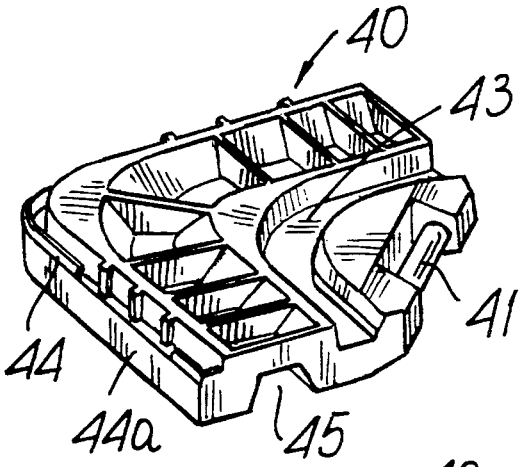
FIG. 5 is a schematic perspective view of the stacking and reinforcement block.
Figure 8:
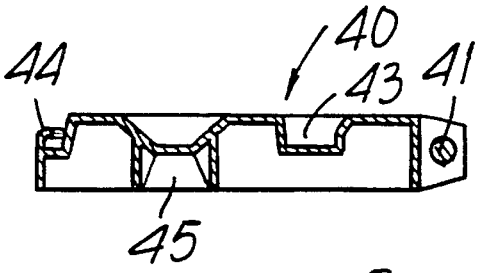
FIG. 8 is a sectional view, taken along the plane VIII—VIII of FIG. 6.
Figure 6:
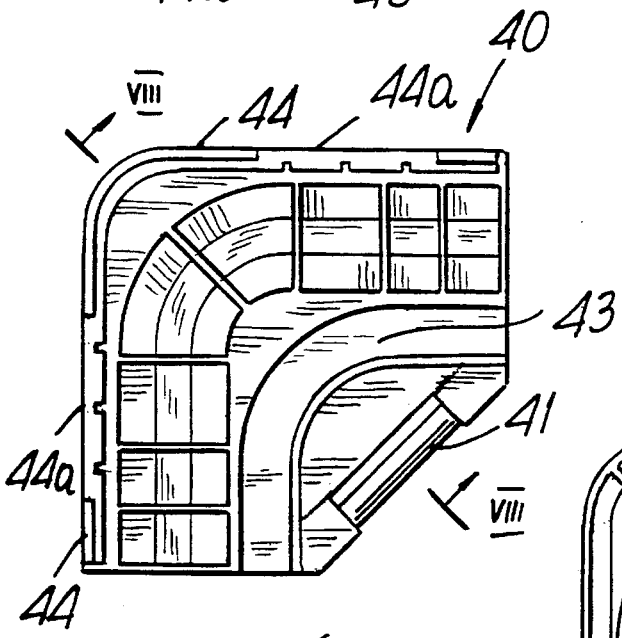
FIG. 6 is a view of one face of the block.
Figure 7:
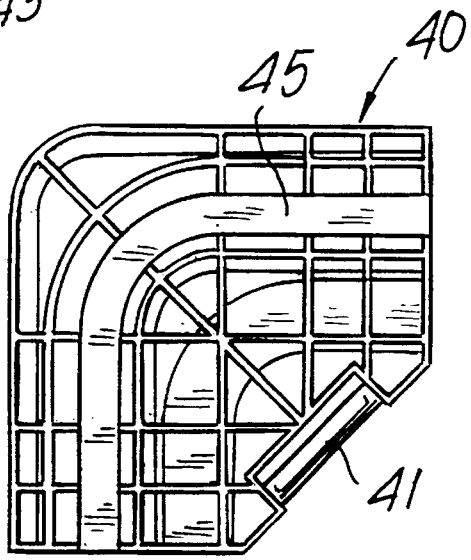
FIG. 7 is a view of the other face of the block.
Figure 9:
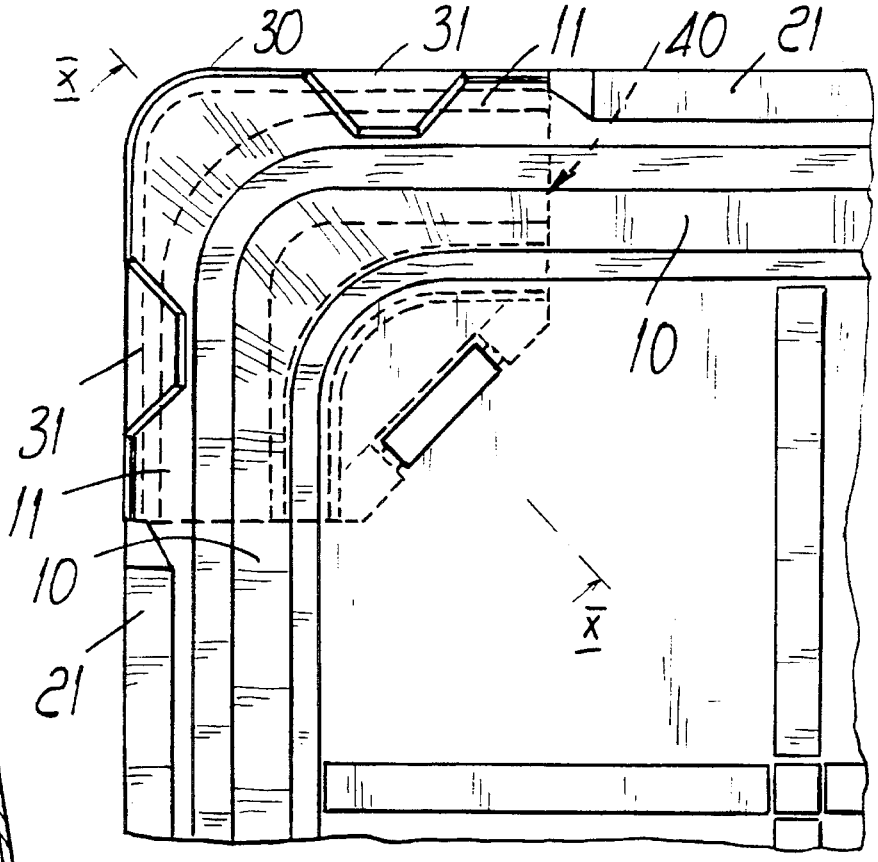
FIG. 9 is a schematic view of the corner of a crate with the block arranged in active position.
Figure 10:
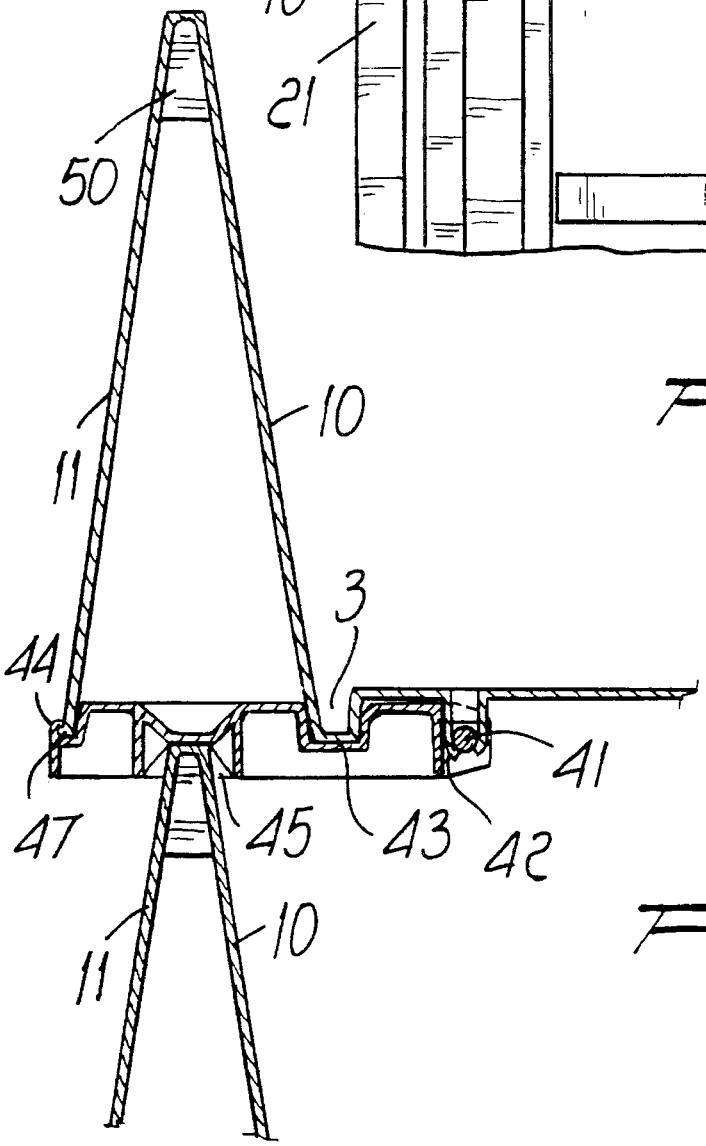
FIG. 10 is a sectional view, taken along the plane X—X of FIG. 9, illustrating two mutually stacked crates.
Figure 11:
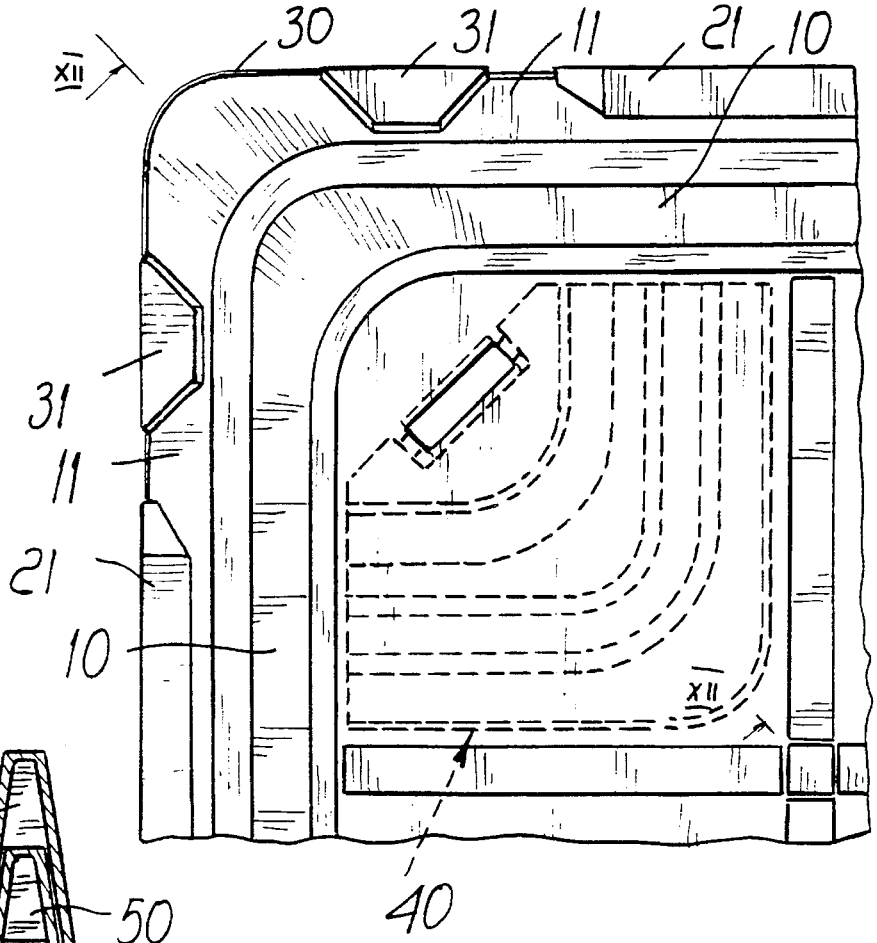
FIG. 11 is a detail view of the corner of a crate with the block in packing position.
Figure 12:
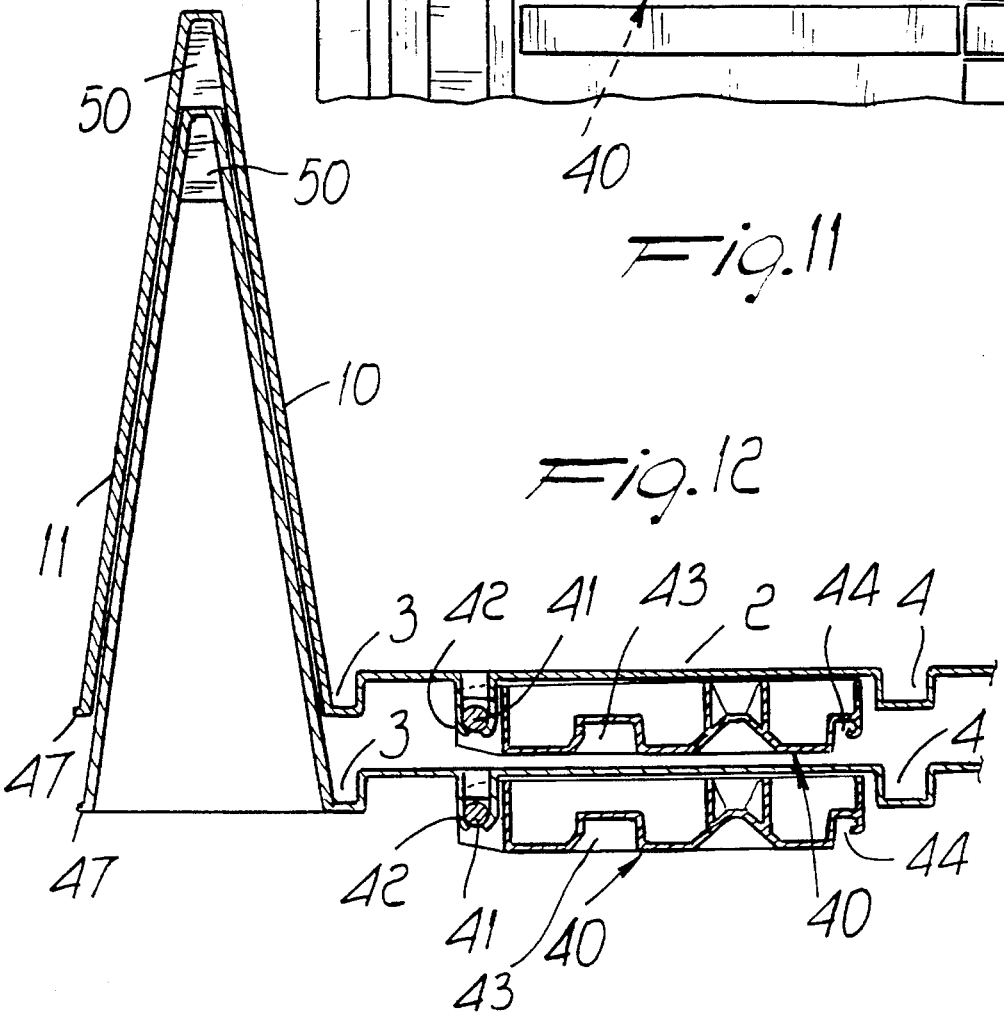
FIG. 12 is a sectional view, taken along the plane XII—XII of FIG. 11, illustrating two mutually packed crates.
Figure 14:
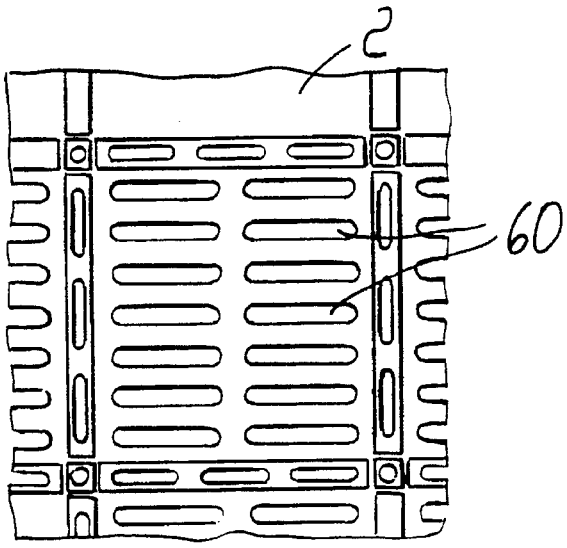
FIGS. 14 and 15 are detail views of the bottom and side walls, with grilled or perforated walls.
Figure 15:
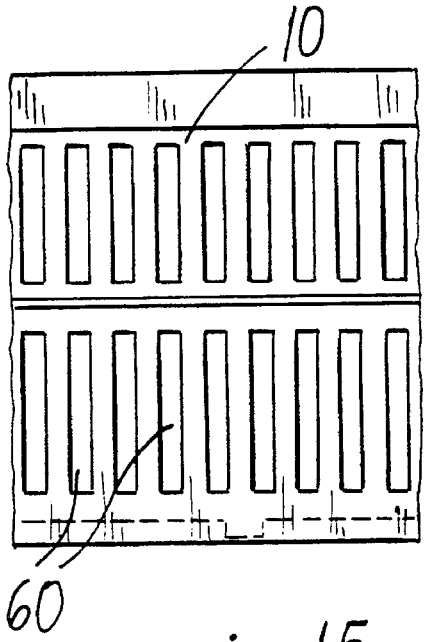
Figure 13:
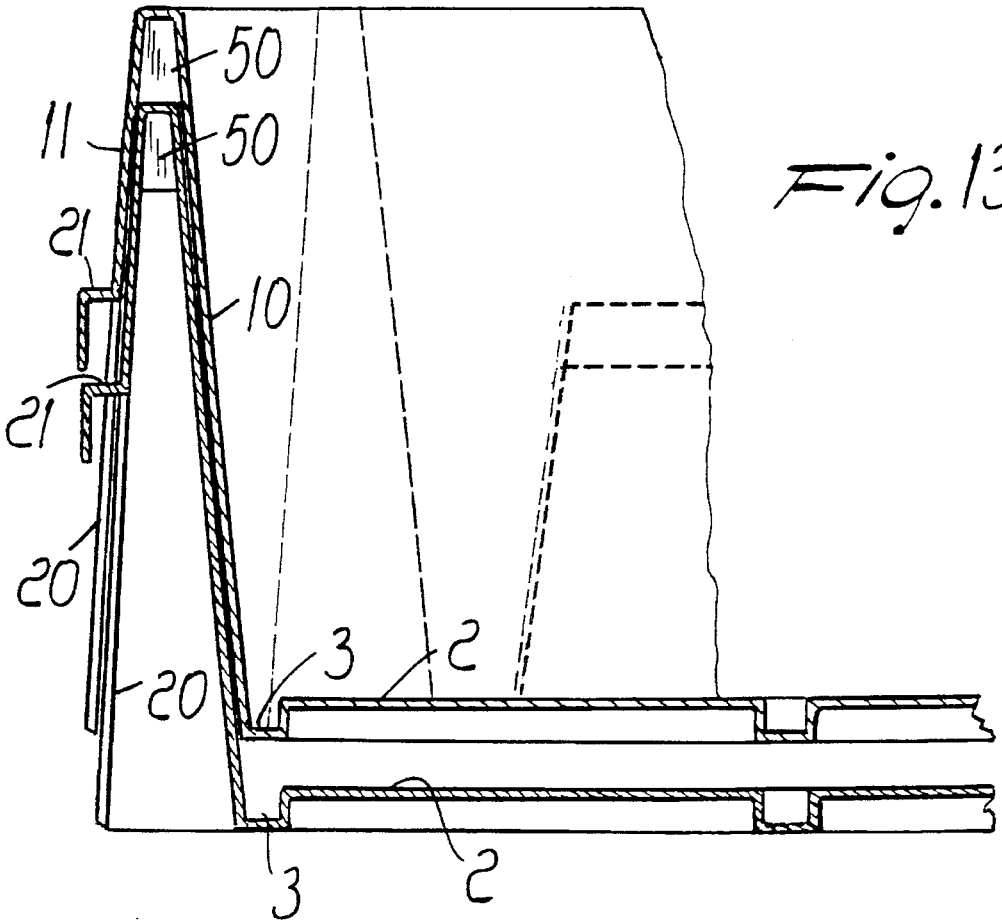
FIG. 13 is a sectional view 0f two packed crates, taken along a plane that passes in a median portion of one side.

An important characteristic of the invention is the fact that it comprises stacking and reinforcement blocks, designated by the reference numeral 40 and shown in FIGS. 5 to 8, which have a substantially square shape with a chamfered corner where there is a pivot 41 for coupling the blocks at corresponding pivoting seats 42 formed on the lower face of the bottom at the corner regions.

The blocks 40 are essentially plate-shaped and form, on one face, an angled groove 43 which is located towards the pivot 41 and a perimetric engagement edge 44 which is formed at the peripheral region of the block.

A packing groove 45 is formed on the other face and extends at an angle; the plate-like element is furthermore constituted by ridges that extend substantially radially witch respect to the region where the pivot 41 is located.

The blocks 40 are inserted below the crate by coupling the pivot 41 at the seats and can be turned over so as to assume an active position, in which they join the lower ends of the inner side walls and of the outer side walls, and a packing position, in which they are arranged below the bottom 2 of the crate.

In greater detail, in the active position the block 40 is overturned so that the hollow 3 arranged perimetrically on the bottom and at the end of the inner side wall couples in the angled groove 43, whereas the lower free edge of the outer side walls, which is advantageously provided with a coupling tooth 47, enters the engagement edge 44.

In this manner the crate is stiffened further, since the inner and the outer side walls are mutually joined and an element is also formed that prevents the mutual packing of the crates; the packing groove 45, in which the upper edge of an underlying crate can be inserted, is formed for this purpose on the other face of the block 40.

In this way it is possible to both mutually stack the crates and to center them, preventing stacked crates from sliding with respect to one another.

It should be noted that the engagement seat 44 has discontinuities **44*a* that allow the protruding parts 31** formed in the corner regions to pass.

In order to pack the empty crates for storage, the blocks, without being separated from the crates, are instead overturned so as to be located at the outer face of the bottom 2 and are advantageously accommodated and retained in the corner square formed by the perimetric hollow and by the ridges 4.

In these conditions, the block does not form awkward thicknesses and allows to mutually pack the crates, since the conical shape of the outer and of the inner side walls allows mutual insertion.

It should also be noted that spacer partitions 50 are formed internally at the upper edge where the inner and the outer side walls connect; by resting on the upper edge of the underlying crate, these partitions prevent the mutual interlocking of the crates, maintaining a very limited play between the superimposed side walls and retaining the wings 21 of the stacked crates so that they are slightly spaced apart so as to allow easy grip for separation.

It should also be noted that the protrusions 32 formed at the corner region do not hinder packing since they have a trapezoidal shape in which the shorter parallel side is directed upwardly.

Experimental tests that have been conducted show that it is possible to have a packing height of approximately 14 mm, i.e. it is possible to contain the thickness of each crate to 14 mm.

It should also be stressed that protruding bulks are not produced with the above described arrangement, i.e. by virtue of the presence of the block 40, which can be turned over from an active position, in which in practice it forms a cross-member between the lower edges of the inner and outer side walls, consequently stiffening the structure, and a packing position in which the block is below the bottom.

Another important aspect of the invention is furthermore constituted by the fact that the crate can be obtained in standard dimensions, which are maintained both when empty and during use, and by using a single material, so that recycling of the material, generally constituted by polypropylene, is possible in compliance with the strictest standards.

The crate can furthermore be easily reused after washing, also by virtue of the fact that the costs for transporting the empty crate are relatively low owing to the crate's modest packing volume.

It should also be added that the side walls and the bottom can be formed without discontinuities, and in this case it is also possible to contain products that lose liquids, or optionally it is possible to provide slots, designated by the reference numeral 60, on the bottom and on the side walls, for containing goods that must be advantageously ventilated.

It is furthermore possible to apply a closure lid that can be superimposed astride the free edge; this is particularly useful for containing perishables such as fish and the like. In this application it should be noted that it is possible to introduce artificial ice for preservation, since the ice is not incompatible with the material of the crate, differently from what currently occurs with foamed-polystyrene fish crates, which in addition to not allowing packing react chemically with artificial ice.

It should also be added that in order to discharge the liquids released by contained products it is possible to form discharge holes on the hollow 3, at the blocks 40, which act as element for conveying said liquids outside the underlying crate.

The invention thus conceived is susceptible to numerous modifications and variations, all of which are within the scope of the inventive concept.

All the details may furthermore be replaced with other technically equivalent elements.

In practice, the materials employed, so long as they are compatible with the specific use, as well as the contingent shapes and dimensions, may be any according to the requirements.

What is claimed is:

1. Generic goods-containing crate that can be stacked during use and can be partially interlocked to form a pack during storage, wherein it comprises a central tray-like body which has a bottom that is delimited, along its perimeter, by inner side walls which are tilted outwards from the bottom towards the upper edge, at least portions of outer side walls extending from said upper edge, said outer side walls surrounding said inner side walls and being inclined outwards from said upper edge towards the free edge, stacking and reinforcement blocks being furthermore provided which can be arranged in an active position, in which they join the lower ends of said inner side walls and of said at least portions of outer side walls, and in a packing position, in which they arrange themselves below said bottom.

2. Crate according to claim 1, wherein it comprises, at the peripheral region of said bottom, a depressed hollow which protrudes towards the outer or lower face of said bottom.

3. Crate according to claim 1, wherein it comprises, on said bottom, a reinforcement grid formed by mutually intersecting hollows.

4. Crate according to claim 1, wherein said inner side walls and said outer side walls have substantially symmetrical inclinations which are opposite with respect to the median vertical plane.

5. Crate according to claim 1, wherein said outer side walls have, at their median portions, recesses which are delimited in an upward region and at their vertical edges by L-shaped wings whose outermost portions lie within the footprint delimited by the base edge of the crate.

6. Crate according to claim 1, wherein said outer side walls have, at their corner regions, recesses which are delimited by protruding regions that have a substantially trapezoidal shape.

7. Crate according to claim 6, wherein the upper end of said protruding regions is spaced from said free edge.

8. Crate according to claim 1, wherein said stacking and reinforcement blocks have a substantially plate-like shape with a substantially square profile having a chamfered corner where there is a pivot that can be coupled in corresponding pivoting seats formed on the lower face of said bottom at the corner regions.

9. Crate according to claim 8, wherein said stacking and reinforcement blocks form, on one face, an angled groove proximate to said pivot and a perimetric engagement edge which is formed at the peripheral region of the block, an angularly extended packing groove being formed on the other face of said blocks.

10. Crate according to claim 9, wherein said angled groove of said blocks engages said depressed hollow when said block is in active position and said perimetric engagement edge couples to the free end of the lower edge of said outer side walls.

11. Crate according to claim 10, wherein said lower free edge of the outer side walls is provided with a coupling tooth.

12. Crate according to claim 9, wherein the upper edge of an underlying crate can be coupled in said packing groove of said stacking and reinforcement block.

13. Crate according to claim 9, wherein said perimetric engagement edge has discontinuities for the passage of said protruding parts formed in the corner regions.

14. Crate according to claim 1, wherein it comprises spacer partitions which are formed between said inner and said outer side walls at said upper edge, said partitions being engageable by contact with the upper edge of the underlying crate.

* * * * *